US010226856B2

(12) United States Patent
Koppenhoefer

(10) Patent No.: US 10,226,856 B2
(45) Date of Patent: Mar. 12, 2019

(54) APPARATUS FOR TIGHTENING THREADED FASTENERS

(71) Applicant: HYTORC Division UNEX Corporation, Mahwah, NJ (US)

(72) Inventor: Peter Koppenhoefer, Portland, PA (US)

(73) Assignee: HYTORC Division UNEX Corporation, Mahwah, NJ (US)

( * ) Notice: Subject to any disclaimer, the term of this patent is extended or adjusted under 35 U.S.C. 154(b) by 50 days.

(21) Appl. No.: 15/123,240

(22) PCT Filed: Feb. 23, 2015

(86) PCT No.: PCT/US2015/017172

§ 371 (c)(1),
(2) Date: Sep. 1, 2016

(87) PCT Pub. No.: WO2015/127408

PCT Pub. Date: Aug. 27, 2015

(65) Prior Publication Data

US 2017/0182640 A1 Jun. 29, 2017

Related U.S. Application Data

(63) Continuation-in-part of application No. PCT/US2014/032289, filed on Mar. 29, 2014.

(60) Provisional application No. 61/942,696, filed on Feb. 21, 2014.

(51) Int. Cl.
*B25B 21/00* (2006.01)

(52) U.S. Cl.
CPC ..... *B25B 21/005* (2013.01)

(58) Field of Classification Search
CPC ..... B25B 21/005; B25B 21/00
USPC ..... 81/57.39
See application file for complete search history.

(56) References Cited

U.S. PATENT DOCUMENTS 2,758,569 A * 8/1956 Peterson ..... B25B 21/004 173/93
4,339,968 A * 7/1982 Krieger ..... B25B 21/005 81/57.39
4,706,527 A * 11/1987 Junkers ..... B25B 21/005 81/57.39
5,003,847 A * 4/1991 Wagner ..... B25B 21/00 81/57.39
5,029,497 A * 7/1991 Junkers ..... B25B 21/005 81/57.39

(Continued)

*Primary Examiner* — Hadi Shakeri
(74) *Attorney, Agent, or Firm* — Justin B. Bender, Esq.

(57) ABSTRACT

According to a first aspect of the invention we provide an automatic reaction pawl-assembly ("ARPA") which includes; a shaft assembly; a pawl fixed rotatably relative to the shaft assembly; and a torsion lever torsionally coupled with the paw) about the shaft assembly. Advantageously the ARPA enhances belting efficiency, increases torque accuracy and maximizes operator safety. Torsion springs of the shaft assembly overcome a housing spring and automatically disengage the pawl from a ratchet wheel. The pawl releases without advancing the fastener, touching the tool or raising the hydraulic pressure beyond an intended torque value. This allows for hands free operation of one or more tools. During SWULTORC® the operator no longer needs to determine which tool; is locked on to its fastener.

21 Claims, 11 Drawing Sheets

(56) References Cited

U.S. PATENT DOCUMENTS

2004/0200320 A1* 10/2004 Knopp ..... B23D 29/005
81/57.39

* cited by examiner

APPARATUS FOR TIGHTENING THREADED FASTENERS

CROSS REFERENCE TO RELATED APPLICATIONS

This Application either claims priority to the following commonly owned patent applications, entire copies of which are incorporated herein by reference: U.S. Application Ser. No. 61/942,696, having Filing Date of 21 Feb. 2014, entitled "APPARATUS FOR TIGHTENING THREADED FASTENERS" and Patent Corporation Treaty Application Serial No. PCT/US2014/032289, having Filing Date of 29 Mar. 2014, entitled "APPARATUS FOR TIGHTENING THREADED FASTENERS".

BACKGROUND OF THE INVENTION

Description of Related Art

Prior art hydraulic tools incorporate reaction pawls that prevent backward movement of a ratchet wheel as a piston moves from a fully extended position to a fully retracted position. They include: a pawl which engages exterior teeth of the ratchet wheel; a spring to attach the pawl to a housing of the tool; and release levers attached to the pawl by pins. The pin members pass through apertures in sidewalls of the housing to allow the release levers to be positioned externally of the housing. The release levers may be used to rotate the reaction pawl out of engagement with teeth of the ratchet wheel.

Hydraulic tools often lock on their fasteners after reaching the desired torque value. The tool is under tension and cannot be removed. The operator must re-pressurize the tool to a flexed condition and while maintaining this pressure, pull back on the release levers. The operator then depressurizes the tool while holding onto the release levers, which allows for easy removal of the tool.

Industrial bolting applications often require use of multiple hydraulic tools. SIMULTORC®, a proprietary bolting method of HYTORC® Division UNEX Corporation, ensures Parallel Joint Closure® and joint integrity. Use of multiple hydraulic tools is especially critical when a gasket buffers closure of a flange. Risk of crushing the gasket increases if the operator assembles the joint, i.e. closes the flange using only one tool. During SIMULTORC®, reaction pawls of one or more hydraulic tools may lockup on one or more of their fasteners. The operator must determine which tools are locked and re-pressurize all tools to a flexed condition. While maintaining this pressure, the operator must pull back on the release levers of one of those locked up tools. The operator then depressurizes the tools while holding onto the release levers. The operator repeats these steps with multiple locked up tools.

The present invention has therefore been devised to address these issues.

BRIEF SUMMARY OF THE INVENTION

According to a first aspect of the invention we provide an apparatus to prevent back rotation of a ratchet of a power tool for tightening or loosening fasteners including: a shaft assembly; a pawl fixed rotatably relative to the shaft assembly; and a torsion lever torsionally coupled with the pawl about the shaft assembly. The apparatus also includes a dowel pin and a housing spring. The shaft assembly also includes: a shaft; a first and a second torsion spring; a first and a second shaft/spring bushing; and a first and a second threaded screw.

Advantageously, apparatus of the present invention increase bolting efficiency, torque accuracy and operator safety. The torsion springs of the shaft assembly automatically overcome the housing spring and disengage the apparatus from the ratchet when the power tool is pressurized to a flexed condition. The pawl releases without advancing the fastener, touching the power tool or raising the hydraulic pressure beyond an intended torque value. This allows for hands free operation of one or more tools thereby increasing bolting efficiency and operator safety. During SIMULTORC®, the operator no longer needs to determine which tool is looked on to its fastener.

BRIEF DESCRIPTION OF THE DRAWINGS

The invention may be described, by way of example only, with reference to the accompanying drawings, of which.

DETAILED DESCRIPTION OF THE INVENTION

Figure 1:
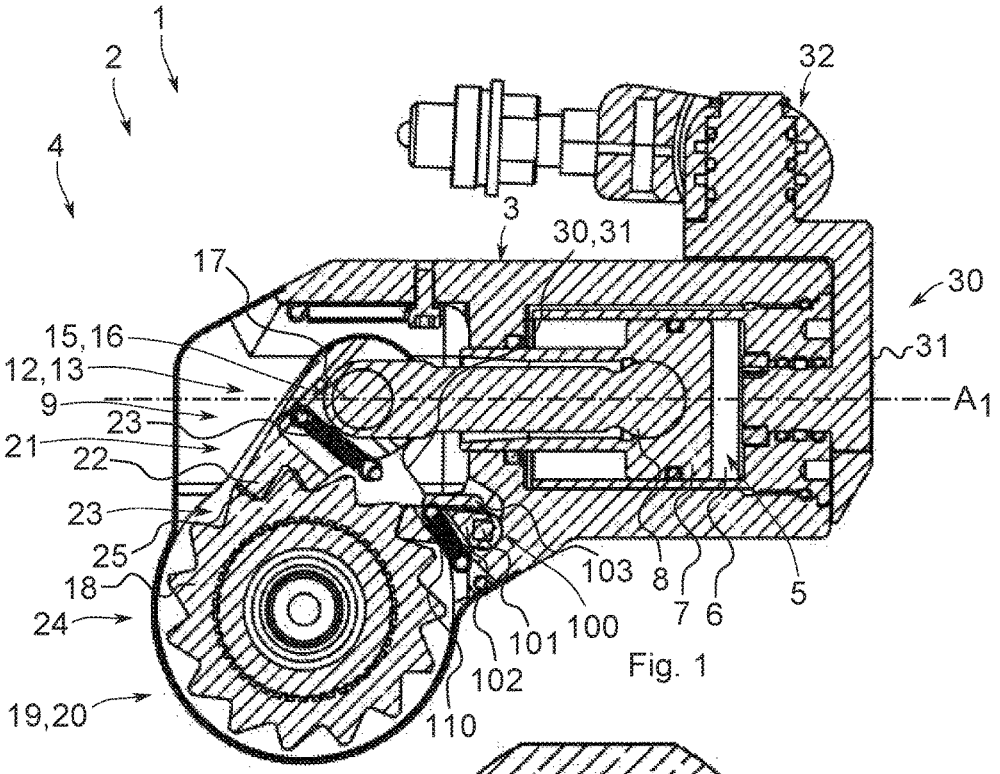
FIG. 1 is a cross-section view showing internal parts of a first power tool for tightening or loosening fasteners having a first embodiment of the apparatus to prevent back rotation of a ratchet.
Figure 2:
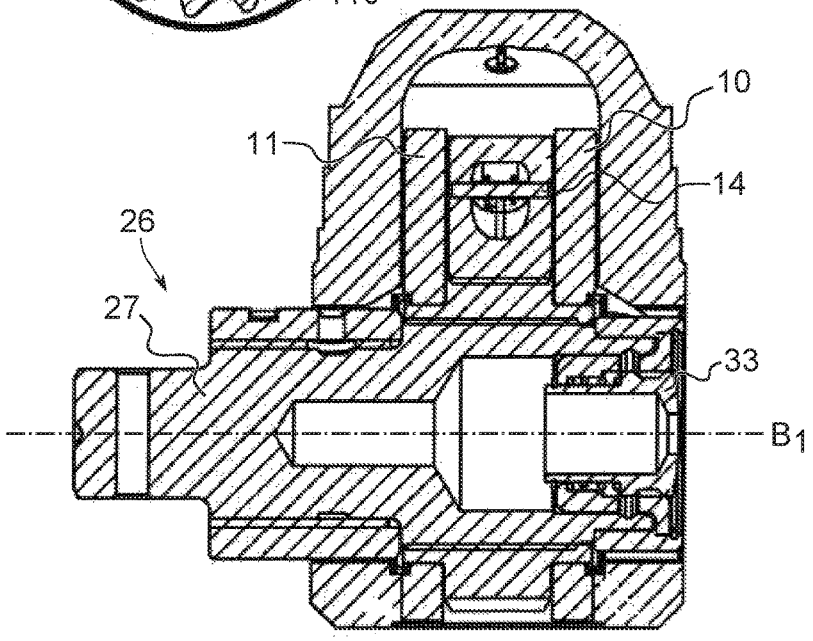
FIG. 2 is another cross-section view showing internal parts of the first power tool of FIG. 1.

Referring to FIGS. 1 and 2, a torque wrench 1 is shown. Torque wrench 1 includes a housing 2 having two housing portions, a cylinder portion 3 and a driving portion 4. A cylinder-piston assembly 5 is arranged in cylinder portion 3 and includes: a cylinder 6; a piston 7 reciprocatingly movable in cylinder 6 along a piston axis $A_1$; and a piston rod 8 connected with piston 7.

A lever-type ratchet assembly 9 is arranged in driving portion 4 and connected to and drivable by cylinder-piston assembly 5. Ratchet assembly 9 includes a pair of drive plates 10 and 11 mounted side-by-side and having upper portions 12 and 13 forming a rod pin slot 14 therebetween and having aligned rod pin bores 15 and 16 for receiving a rod pin 17 mounted therein. Drive plates 10 and 11 are supported for partial rotation within driving portion 4 around a ratchet wheel 18. Lower portions 19 and 20 of drive plates 10 and 11 are shaped similarly as part of driving portion 4. Upper portions 12 and 13 of driving plates 10 and 11 define a generally triangular, downward opening area containing a similarly shaped drive pawl assembly 21.

Drive pawl assembly 21 includes a drive pawl 22 that is mounted therein with limited vertical travel within an indention dictated by a drive pawl spring 23. Drive pawl spring 23 bears against the upper portion of drive pawl 22 for maintaining ratcheting spring pressure against drive pawl 22 and forcing drive pawl 22 against ratchet wheel 18. Ratchet wheel 18 has peripheral driven teeth 24 which mesh with driving teeth 25 on the underside of drive pawl 22. Drive pawl 22 is driven forward by drive plates 10 and 11 which is driven by piston rod 8. Likewise ratchet wheel driven teeth 24 are driven in forward rotation. When piston rod 8 is retracted, drive pawl spring 23 is extended by drive pawl 22 when driving teeth 25 ratchet back over ratchet wheel driven teeth 24 to the withdrawn position. These actions affect a square drive assembly 26 which has a drive shaft 27 that rotates relative to housing 2 around a drive axis $B_1$. During operation tool 1 creates and passes a turning force 91 to a threaded fastener (not shown) in one direction 93 and a corresponding reaction force 92 in another direction 94 to a stationary object (not shown), both along a drive axis $B_1$.

Tool also includes: a rear swivel assembly 30; an end cap cover 31; a swivel block assembly 32; a drive retainer assembly 33; and various plates, set screws, seals, retaining rings; o-rings, pins, and plugs.

FIG. 1 also shows an automatic reaction pawl assembly ("ARPA") 100 of the present invention. ARPA 100 includes: a shaft assembly 101; a pawl assembly 102 fixed rotatably relative to shaft assembly 101; and a lever assembly 103 torsionally coupled with pawl assembly 102 about shaft assembly 101. Shaft assembly 101 includes: a shaft 104; a first and a second washer 112; and a first and a second threaded screw 117. Pawl assembly 102 includes: a reaction pawl 107; a housing compression spring assembly 110; and a dowel pin 116. Lever assembly 103 includes: a torsion lever 108; a torsion spring assembly 105 having: first and a second torsion spring 106; and a first and a second shaft/spring bushing 114.

ARPA 109 is rotatably attached to an inner side of a lower peripheral wall of driving portion 4 of housing 2 by means of housing compression spring assembly 110 and dowel pin 116. Spring assembly 110 is formed between and resistively attached to pawl 107 and tool 1. It restricts rotation of pawl assembly 102 and shaft assembly 101 relative to lever assembly 103. ARPA 100 is held in position against ratchet wheel 18 by rotational spring pressure from spring assembly 110. ARPA 100 is held in position relative to housing 2 by washers 112 and screws 117. Generally ARPA 100 engages ratchet teeth 24 and allows ratchet wheel 18 to rotate in a forward direction by spring action, but prevent back rotation when engaged. This keeps ratchet wheel 18 from rotating back with drive pawl 21.

Often at the end of a piston stroke the fastener reaches full torque and ARPA 100 drops into a ratchet tooth 24. Stress between a socket (not shown) or other driver and a reaction mechanism (not shown) causes tool 1 to lock into place due to torsional flex of housing 2 and drive assembly 21. The operator re-pressurizes tool 1 to relax and remove it from the tightened fastener. With tool 1 in this re-pressurized and flexed condition the reaction force is redistributed from ARPA 100 to drive pawl assembly 21 and housing 2.

Advantageously, ARPA 100 increases bolting efficiency, torque accuracy and operator safety. Torsion spring assembly 105 of shaft assembly 101 automatically overcomes housing compression spring 110 and disengages pawl assembly 102 from ratchet wheel 18. Pawl assembly 102 releases without advancing the fastener, touching tool 1 or raising the hydraulic pressure beyond an intended torque value. This allows for ands free operation of one or more tools. During SIMULTORC®, the operator no longer needs to determine which tool is locked on to its fastener.

Figure 3:
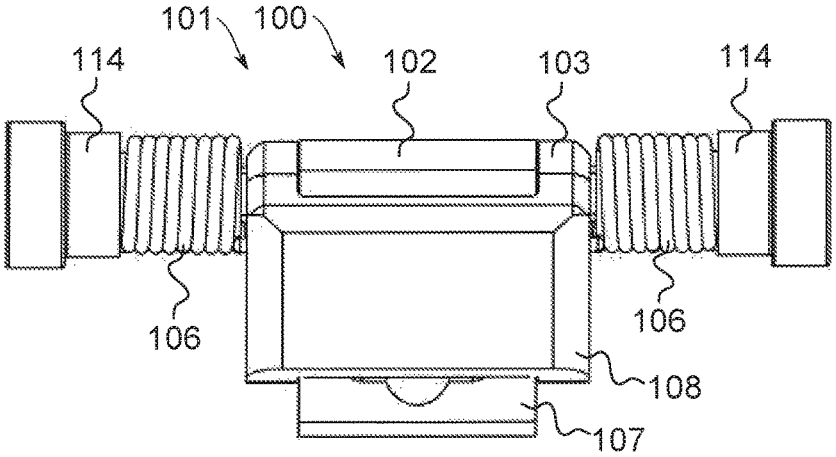
FIG. 3 is a top view of the first embodiment of the apparatus.
Figure 4:
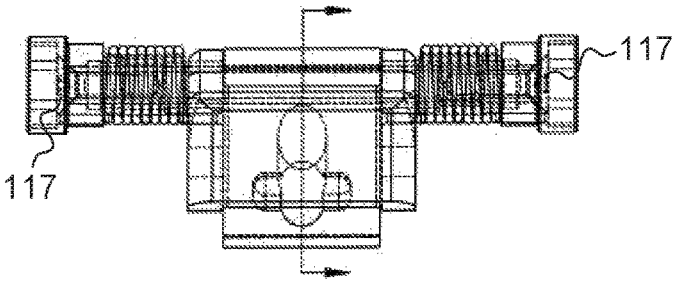
FIG. 4 is a top view showing internal parts of the first embodiment of the apparatus.
Figure 5:
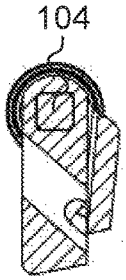
FIG. 5 is a side view showing internal parts of the first embodiment of the apparatus.
Figure 6:
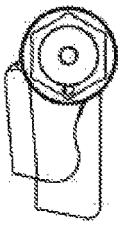
FIG. 6 is a side view of the first embodiment of the apparatus.
Figure 7:
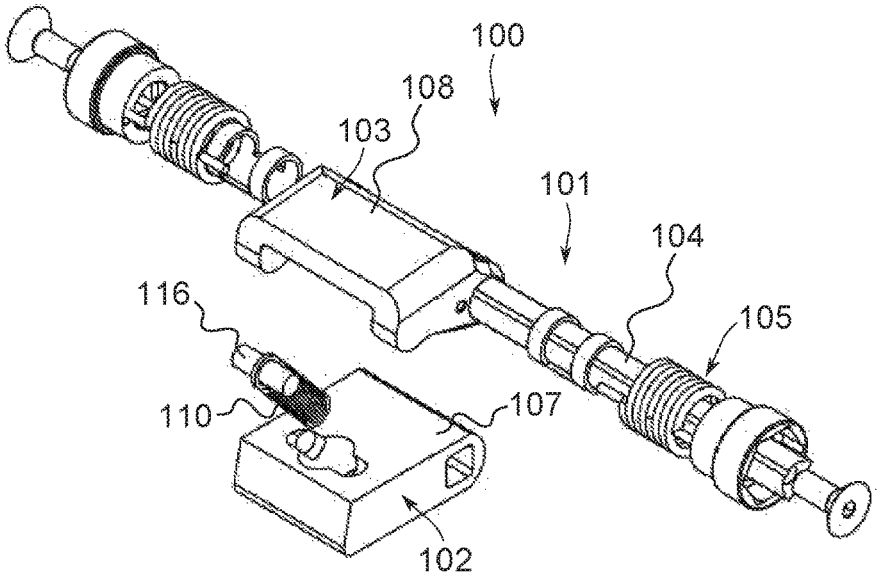
FIG. 7 is an exploded perspective view of the first embodiment of the apparatus.

FIGS. 3-7 show various views of ARPA 100. More specifically, FIG. 3 shows a top view of ARPA 100. FIG. 4 shows a top view of internal components of ARPA 100. FIG. 5 shows a side view of internal parts of ARPA 100. FIG. 6 shows a side view of ARPA 100. And FIG. 7 shows an exploded perspective view of ARPA 100.

Figure 8:
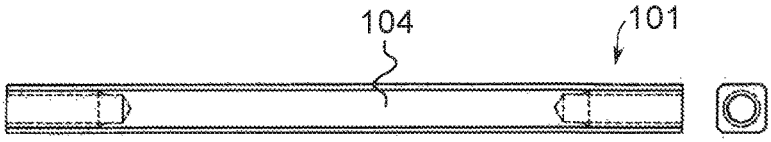
FIG. 8 shows various views of a shaft of the assembly of the first embodiment of the apparatus.

FIGS. 8-13 show various views of the components of ARPA 100 including shaft assembly 101, pawl assembly 102, lever assembly 103, torsion spring assembly 105, washers 112 and bushings 114. FIG. 8 shows various views of shaft 104 of shaft assembly 101 of ARPA 100. Shaft 101 is shown as a square shaped rod but may be any suitable geometry such as triangular, hexagonal or spline. Shaft 104 includes axial bores at each end to receive threaded portions of screws 117.

Figure 9:
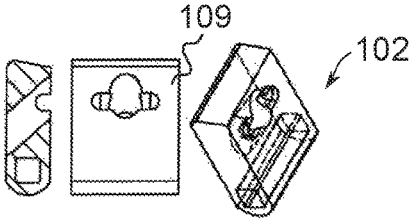
FIG. 9 shows various views of a pawl of the first embodiment of apparatus.

FIG. 9 shows various views of pawl 107 of pawl assembly 102 of ARPA 10. Pawl 107 is shown in the general shape of rectangular solid but may be any suitable geometry. An axial square bore at a first end of pawl 107 receives shaft 104 to non-rotatably engage pawl 107 to shaft assembly 101. A second end of pawl 107 is tapered to suitably engage ratchet teeth 24 of ratchet wheel 18. A horizontal bore through pawl 107 receives a first end of housing compression spring 110. The horizontal bore has a first end point on a top surface of pawl 107 near the second end and a second end point on a bottom surface of pawl 107 near the first end. A cylindrical cut-out at the first end point of the horizontal bore receives dowel pin 116. Spring 110 resistively attaches pawl 107 and tool 1 and restricts rotation of pawl 107 and therefore shaft assembly 101.

Figure 10:
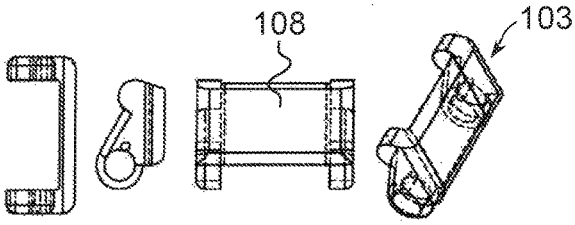
FIG. 10 shows various views of a torsion lever of the first embodiment of the apparatus.

FIG. 10 shows various views of torsion lever 108 of lever assembly 103 of ARPA 100. Torsion lever 108 is shown in the general shape of a partially hollow rectangular solid but may be any suitable geometry. An axial round bore at a lower first end of torsion lever 108 receives shaft 104 to rotatably engage torsion lever 108 to shaft assembly 101. When assembled, a hollow underside portion of torsion lever 108 receives a substantial portion of pawl 107. The second end of pawl 107 extends beyond a second end of torsion lever 108. The first end of torsion lever 108 is rounded to accommodate shaft 104. Similarly the second end of torsion lever 108 is rounded to follow an outer contour 30 and 31 of drive plates 10 and 11 of tool 1. The sides of torsion lever 108 taper upward such that the first end is deeper than the second end. The sides also have rounded bores to receive first ends of torsion springs 106.

Figure 11:
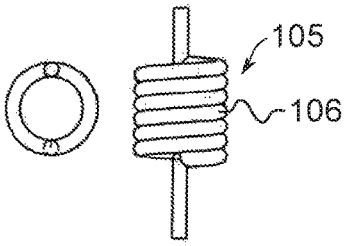
FIG. 11 shows various views of a torsion spring of the shaft assembly of the first embodiment of the apparatus.

FIG. 11 shows various views of torsion springs 106 of lever assembly 103 of ARPA 100. Torsion springs 108 are metal rods or wire in the shape of a helix, e.g. coil, which is subjected to twisting about the axis of the coil. The sideways forces, e.g. bending moments, applied to its ends, twist the coil tighter. Note that this terminology can be confusing because in a helical torsion spring the forces acting on the wire are actually bending stresses, not torsional, e.g. shear, stresses. The Applicant, however, considers this terminology interchangeable for ease of description. The rounded bores through the sides of torsion lever 108 receive the first ends of torsion springs 106.

Figure 12A:
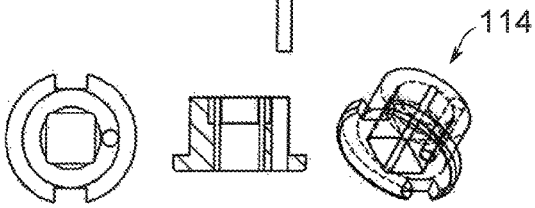
FIGS. 12A and 12B show various views of the bushings of the shaft assembly of the first embodiment of the apparatus.
Figure 12B:
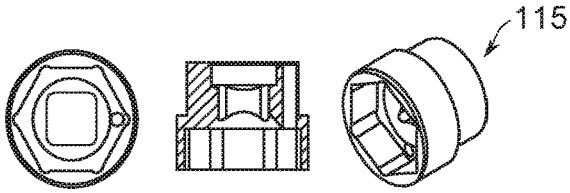

FIG. 12A shows various views of shaft/spring bushings 114 of lever assembly 108 of ARPA 100. Bushings 114 are shown in the general shape of cylindrical solids but may be any suitable geometry. Axial square bores through bushings 114 receive shaft 104 to non-rotatably engage bushings 114 to shaft assembly 101. Bushings 114 are fixed rotatably relative to shaft assembly 101 and formed between torsion springs 105 and washers 112. Round bores at first ends of bushings 114 receive second ends of torsion springs 105. Thus torsion springs 105 are formed between and are resistively and rotatably coupled to torsion lever 103 and bushings 114. FIG. 12B shows various views of shaft/spring bushings 115 of lever assembly 103 of ARPA 100. Bushings 115 differ from bushings 114 by including a hex engagement to allow access to and manipulation of ARPA 100 external of housing 2 by the operator.

Figure 13:
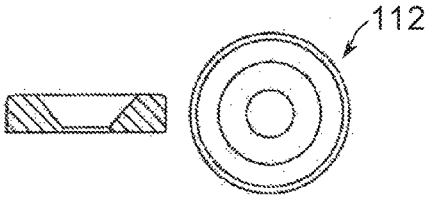
FIG. 13 shows various views of the washer of the shaft assembly of the first embodiment of the apparatus.

FIG. 13 shows various views of washers 112 of shaft assembly 104 of ARPA 100. Washers 112 are shown in the general shape of cylindrical solids but may be any suitable geometry. Tapered round bores extend through washers 112 to receive screws 117. Washers 112 are formed at axial ends of shaft 104 and allow assembly of and attachment of ARPA 100 to tool 1 by screws 117. Washers 112 are external of housing 2 in this assembled state. Note that ARPA 100 may not include washers 112 when bushings 114 and/or 115 are used.

Figure 14:
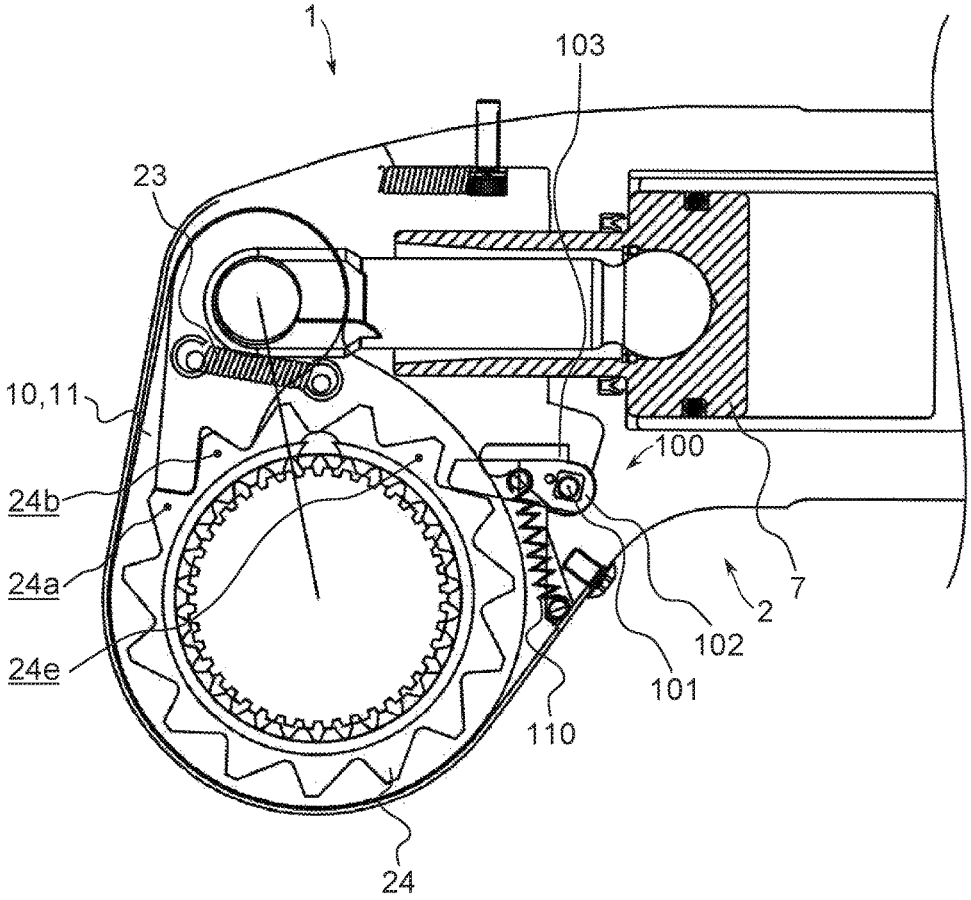
FIG. 14 shows the first power tool at a beginning of a retract portion of a piston stroke.

FIGS. 14-19 show cross-sectional views of tool 1 during various stages of industrial bolting operation. FIG. 14 shows tool 1 at a beginning of a retract portion of a piston stroke. Piston 7 and drive plates 10 and 11 are fully advanced. Drive pawl spring 23 is slightly loaded which provides slight resistive force against drive pawl 21 and drive plates 10 and 11. Drive pawl 21 is slightly engaged with a first and a second ratchet tooth 24*a* and 24*b* and applies no force to ratchet 24. ARPA spring 110 is slightly loaded which provides slight resistive force against ARPA pawl assembly 102 and housing 2. ARPA pawl assembly 102 is disengaged from a fifth ratchet tooth 24*e* and, as shown, provides no resistive force to prevent ratchet 24 from turning back. ARPA torsion springs 105 are minimally loaded as ARPA pawl assembly 102 and ARPA lever assembly 103 are at the defined rotatably relative neutral position. ARPA lever 108 is at a base contour of drive plates 10 and 11.

Figure 15:
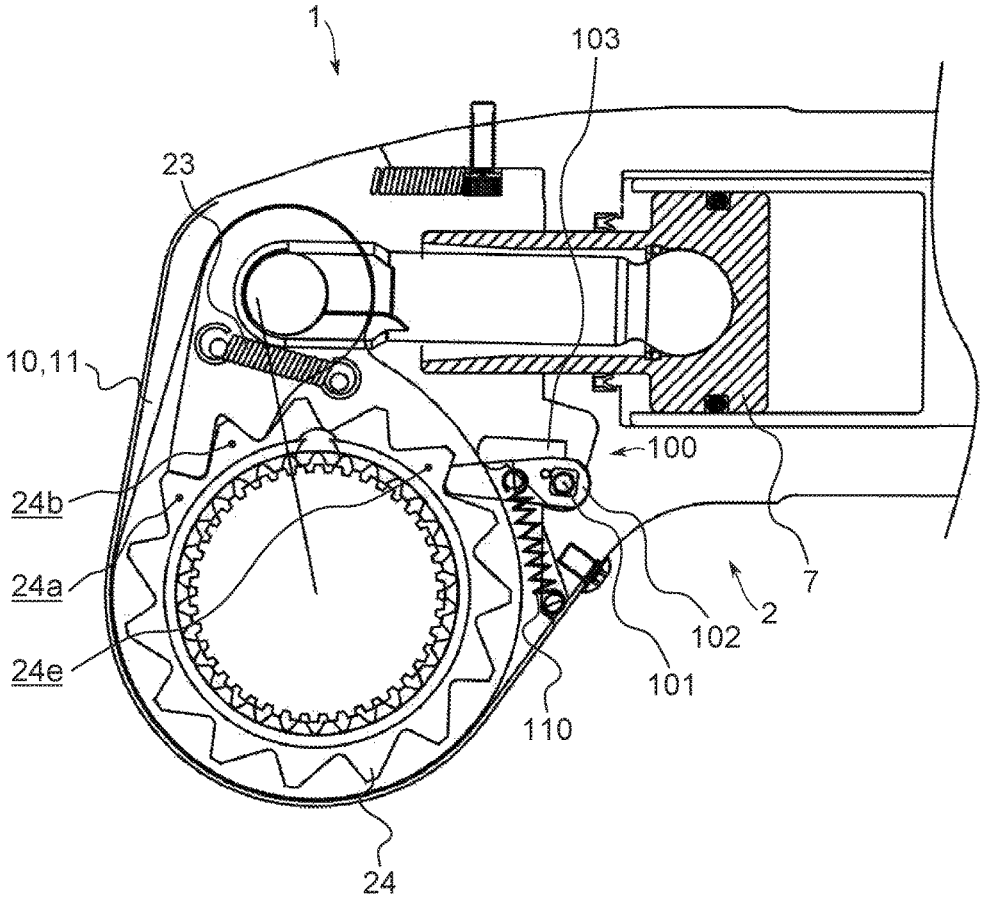
FIG. 15 shows the first power tool during the retract portion of the piston stroke.

FIG. 15 shows tool 1 during the retract portion of the piston stroke. Piston 7 and drive plates 10 and 11 are partially retracted. Drive pawl spring 23 is slightly loaded which provides slight resistive force against drive pawl 21 and drive plates 10 and 11. Drive pawl 21 is minimally engaged with first and second ratchet teeth 24*a* and 24*b* and applies minimal force to push ratchet 24 forward. ARPA spring 110 is slightly loaded which provides slight resistive force against ARPA pawl assembly 102 and housing 2. ARPA pawl assembly 102 is moderately engaged with fifth ratchet tooth 24*e* and applies sufficient force to prevent ratchet 24 from turning back. ARPA torsion springs 105 are moderately loaded as ARPA pawl assembly 102 and ARPA lever assembly 103 are moderately beyond the defined rotatably relative neutral position. ARPA lever 10 starts to ride up contour of drive plates 10 and 11.

Figure 16:
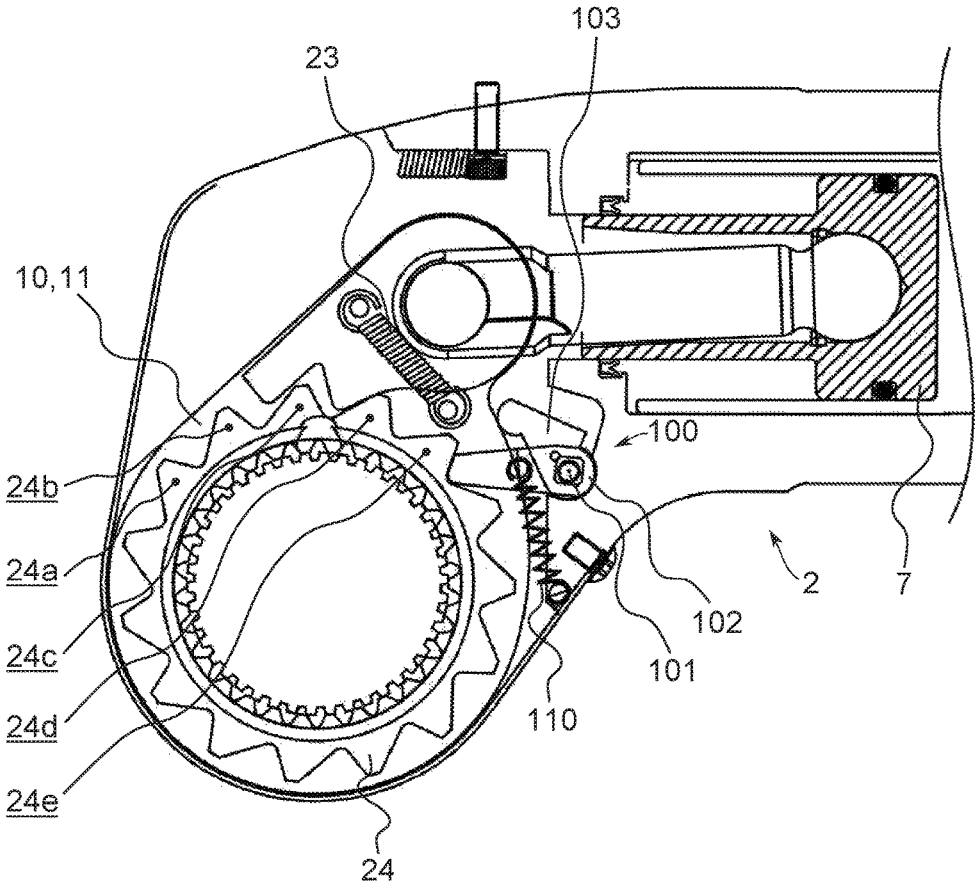
FIG. 16 shows the first power tool at the end of the retract portion and/or the beginning of an advancement portion of the piston stroke.

FIG. 16 shows tool 1 at the end of the retract portion and/or the beginning of an advancement portion of the piston stroke. Piston 7 and drive plates 10 and 11 are fully retracted (or minimally advanced). Drive pawl spring 23 is fully loaded which provides full resistive force against drive pawl 21 and drive plates 10 and 11 and. Drive pawl 21 is disengaged from the second and a third ratchet tooth 24*b* and 24*c* and applies no force to push ratchet 24 forward. Drive pawl 21 is moderately engaged with a fourth ratchet tooth 24*d* and applies moderate force to pull ratchet 24 back. ARPA spring 110 is slightly loaded which provides slight resistive force against ARPA pawl assembly 102 and housing 2. ARPA pawl assembly 102 is fully engaged with fifth ratchet tooth 24*e* and force is applied to prevent ratchet 24 from turning back. ARPA torsion springs 105 are fully loaded as ARPA pawl assembly 102 and ARPA lever assembly 103 are fully beyond the defined rotatably relative neutral position. ARPA lever 108 is at an apex contour of drive plates 10 and 11.

Figure 17:
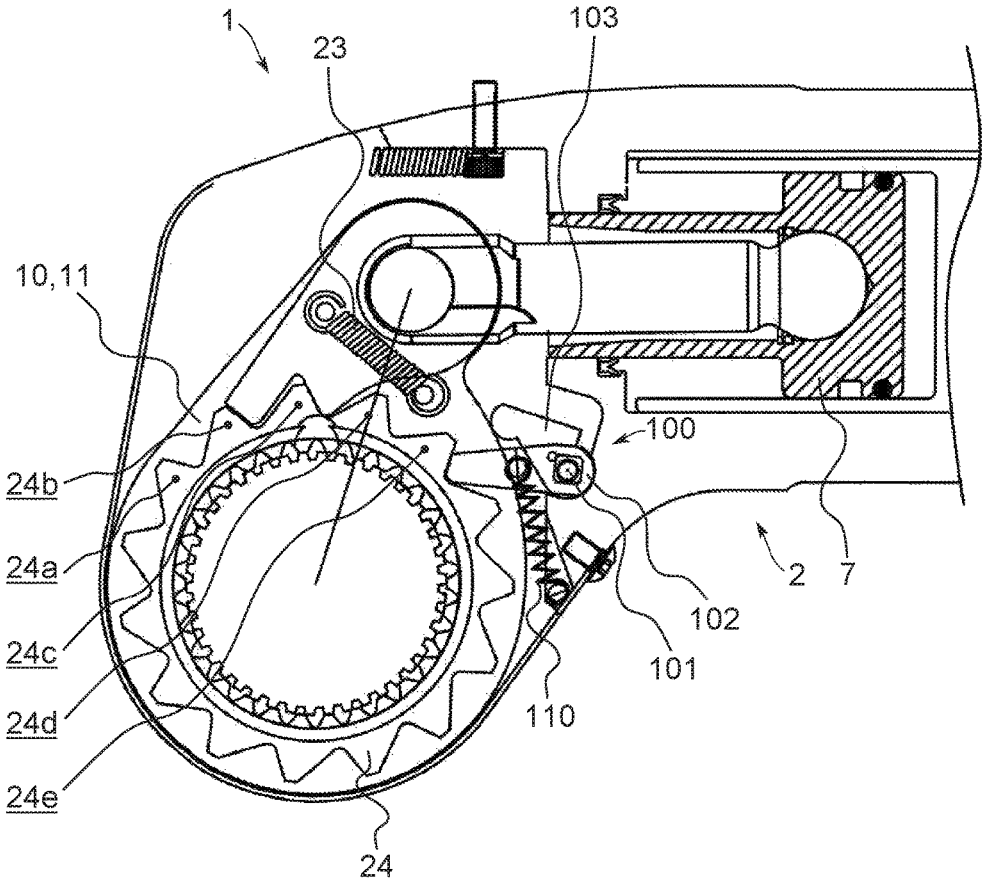
FIG. 17 shows the first power tool during the advancement portion of the piston stroke.

FIG. 17 shows tool 1 during the advancement portion of the piston stroke. Piston 7 and drive plates 10 and 11 are partially advanced. Drive pawl spring 23 is minimally loaded which provides minimal resistive force against drive pawl 21 and drive plates 10 and 11. Drive pawl 21 is fully engaged with the second and third ratchet tooth 24*b* and 24*c* and applies full force to push ratchet 24 forward. ARPA spring 110 is slightly loaded which provides slight resistive force against ARPA pawl assembly 102 and housing 2. ARPA pawl assembly 102 is slightly engaged with yet starts to disengage from fifth ratchet tooth 24*e*. ARPA pawl assembly 102 disengages from fifth ratchet tooth 24*e* to return to relaxed position as ratchet 24 is further advanced. ARPA torsion springs 105 are slightly loaded as ARPA pawl assembly 102 and ARPA lever assembly 103 are slightly beyond the defined rotatably relative neutral position. ARPA lever 108 starts to ride down contour of drive plates 10 and 11 thereby relaxing ARPA torsion springs 105 to slightly loaded.

Figure 18:
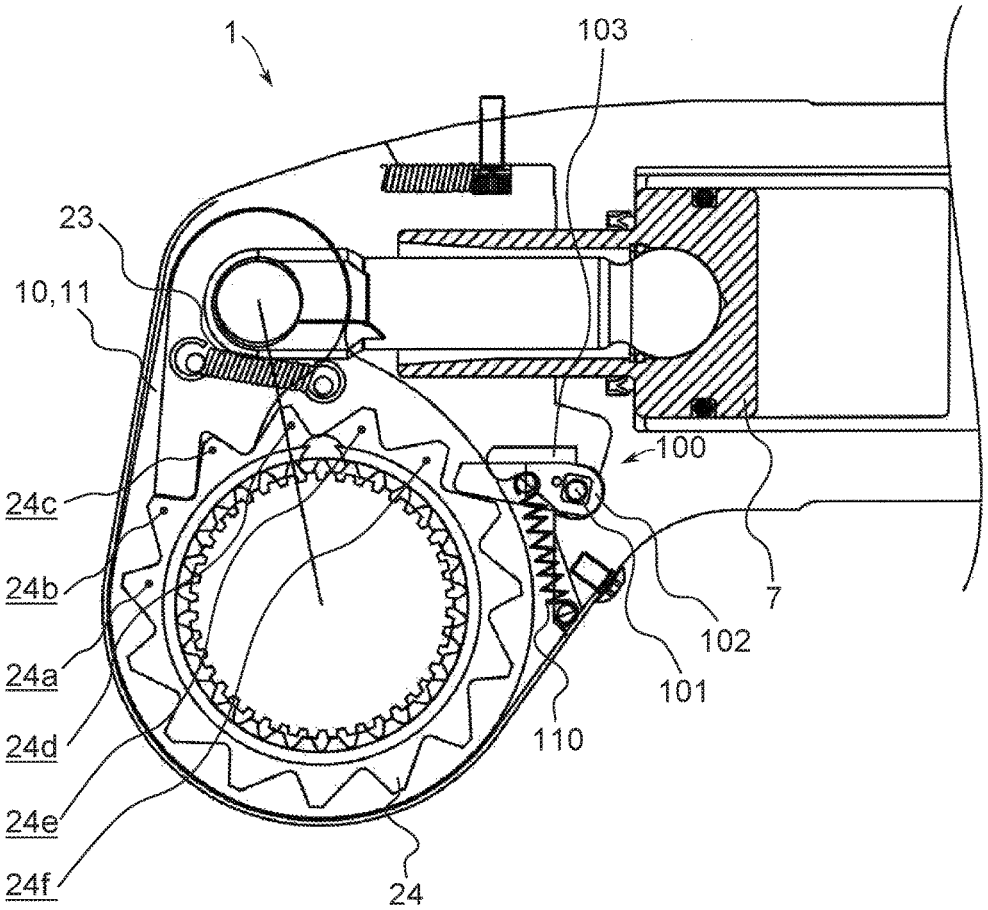
FIG. 18 shows the first power tool at an end of the advancement portion of the piston stroke.
Figure 19:
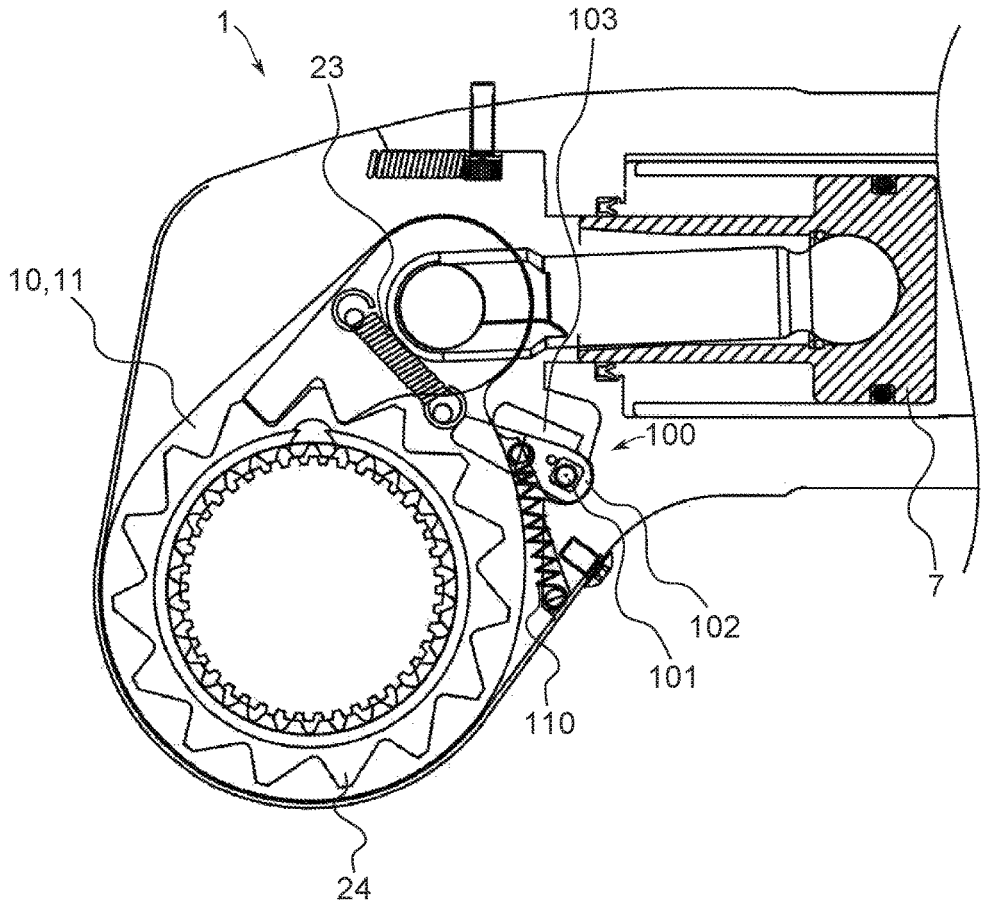
FIG. 19 shows the first power tool in a relaxed setting with apparatus in a disengaged position.

FIG. 18 shows tool 1 at an end of the advancement portion of the piston stroke. Piston 7 and drive plates 10 and 11 are fully advanced. Drive pawl spring 23 is minimally loaded which provides minimal resistive force against drive pawl 21 and drive plates 10 and 11. Drive pawl 21 is moderately engaged with the second and third ratchet tooth 24*b* and 24*c* and applies moderate hydraulic force to push ratchet 24 forward. ARPA spring 110 is slightly loaded which provides slight resistive force against ARPA pawl assembly 102 and housing 2. ARPA pawl assembly 102 is disengaged from a sixth ratchet tooth 24*f* and applies no force to prevent ratchet 24 from turning back. ARPA torsion springs 105 are minimally loaded as ARPA pawl assembly 102 and ARPA lever assembly 103 are at the defined rotatably relative neutral position. ARPA lever 108 is at the base contour of drive plates 10 and 11.

FIG. 13 shows tool 1 in a relaxed setting with ARPA 100 in a disengaged position. Piston 7 and drive plates 10 and 11 are fully retracted. Drive pawl spring 23 is minimally loaded which provides minimal resistive force against drive pawl 21 and drive plates 10 and 11. Drive pawl 21 is slightly engaged with ratchet 24 yet applies no force to ratchet 24. ARPA spring 110 is fully loaded which provides full resistive force against ARPA pawl assembly 102 and housing 2. ARPA pawl assembly 102 is disengaged from ratchet 24 and applies no force to prevent ratchet 24 from turning back. ARPA torsion springs 105 are slightly loaded as ARPA pawl assembly 102 and ARPA lever assembly 3 are slightly beyond the defined rotatably relative neutral position. ARPA lever 108 is at an apex contour of drive plates 10 and 11.

Generally this embodiment of the automatic reaction pawl assembly of the present invention prevents back rotation of a ratchet of a square drive assembly-type power tool for tightening and/or loosening threaded fasteners. This embodiment of the automatic reaction pawl assembly includes: a shaft assembly; a pawl assembly; and a lever assembly. The lever assembly is torsionally coupled with the pawl assembly about the shaft assembly. Note that either the pawl assembly or the lever assembly may be fixed rotatably relative to the shaft assembly. A torsion spring assembly of the lever assembly is formed between and resistively rotatably coupled to the shaft assembly and a first and a second bushing of the lever assembly. A compression spring of the lever assembly is formed between and resistively rotatably coupled relative to the pawl assembly. A compression spring of the pawl assembly is formed between and resistively attached to the power tool, wherein the compression spring restricts rotation of the pawl assembly and the shaft assembly relative to the lever assembly. The bushings are fixed rotatably relative to the shaft assembly and formed between the torsion spring assembly and a threaded screw assembly of the shaft assembly. The screw assembly is formed at axial ends of the shaft assembly and allows assembly of and attachment of the apparatus to the power tool.

Advantageously resistive force against relative rotation of the pawl assembly and the lever assembly allows an operator to pressurize the power tool to a flexed condition to disengage this embodiment of the automatic reaction pawl assembly from the ratchet without advancing the fastener or touching the power tool. Likewise when the power tool is pressurized to a flexed condition and a reaction force load is transferred from this embodiment of the automatic reaction pawl assembly, resistive force against relative rotation of the pawl assembly and the lever assembly disengages the reaction pawl assembly from the ratchet. Further, resistive force against relative rotation of the pawl assembly and the lever assembly increases from a defined neutral position when the lever assembly follows a contour of drive plates of the power tool. The torsion spring assembly overcomes the compression spring and disengages the pawl assembly from the ratchet when the power tool is pressurized to a flexed condition and a reaction force load is transferred from this embodiment of the automatic reaction pawl assembly.

Figure 20:
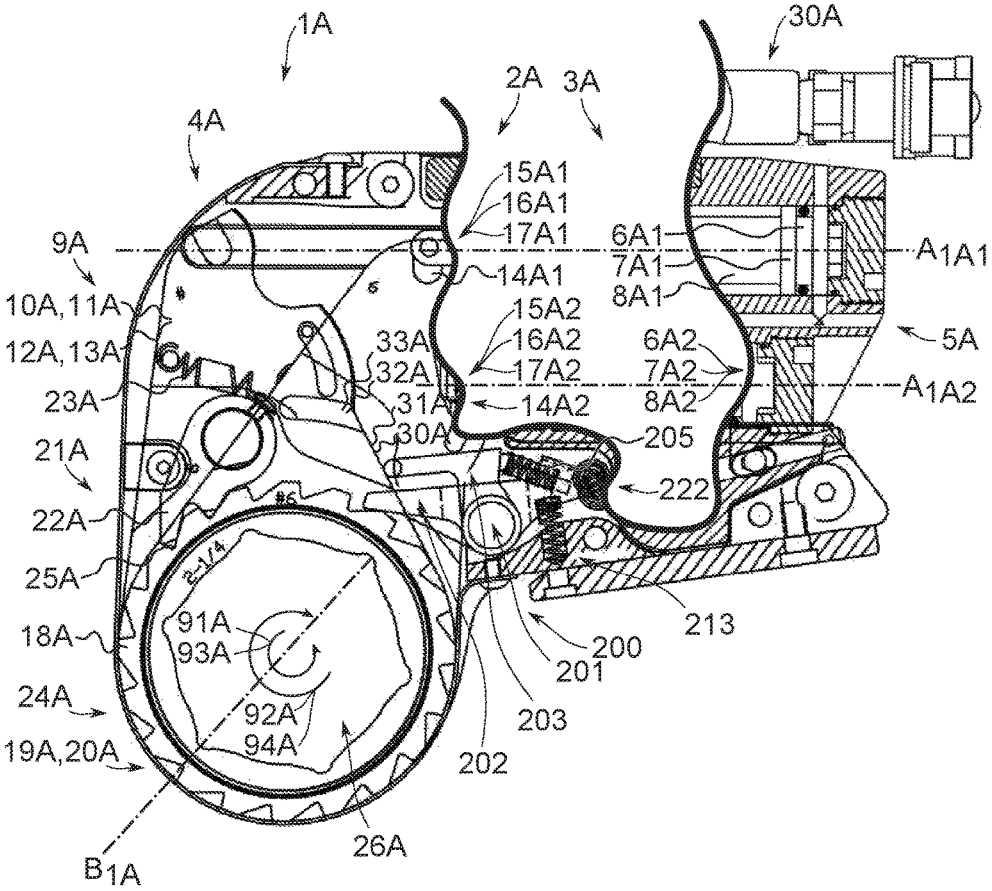
FIG. 20 is a cross-section view showing internal parts of a second power tool for tightening or loosening fasteners having a second embodiment of the apparatus prevent back rotation of a ratchet.

Referring to FIG. 20, a ink-style, or a pass-through socket drive assembly-type, torque wrench 1A for limited clearance bolting applications is shown. Torque wrench 1A includes a housing 2A having two housing sections, a cylinder section 3A and a driving section 4A. A cylinder-piston assembly 5A is arranged in cylinder section 3A and includes: two cylinders 6A1 and 6A2; two pistons 7A1 and 7A2 reciprocatingly movable in cylinders 6A1 and 6A2 along two piston axes $A_{1A2}$ and $A_{1A2}$; and two piston rods 8A1 and 8A2 connected with pistons 7A1 and 7A2.

A lever-type ratchet assembly 9A is arranged in driving section 4A and connected to and drivable by cylinder-piston assembly 5A. Ratchet assembly 9A includes a pair of drive plates 10A and 11A mounted side-by-side and having upper portions 12A and 13A forming two rod pin slots 14A1 and 14A2 therebetween and having aligned rod pin bores 15A1 and 16A1 and 15A2 and 16A2 for receiving rod pins 17A1 and 17A2 mounted therein. Drive plates 10A and 11A are supported for partial rotation within driving section 4A around a ratchet wheel 18A. Lower portions 19A and 20A of drive plates 10A and 11A are shaped similarly as part of driving section 4A. Upper portions 12A and 13A of driving plates 10A and 11A define a generally triangular, downward opening area containing a similarly shaped drive pawl assembly 21A.

Drive pawl assembly 21A includes a drive pawl 22A that is mounted therein with limited vertical travel within an indention dictated by a drive pawl spring 23A. Drive pawl spring 23A bears against the upper portion of drive pawl 22A for maintaining ratcheting spring pressure against drive pawl 22A and forcing drive pawl 22A against ratchet wheel 18A. Ratchet wheel 18A has peripheral driven teeth 24A which mesh with driving teeth 25A on the underside of drive pawl 22A. Drive pawl 22A is driven forward by drive plates 10A and 11A which is driven by piston rods 8A1 and 8A2. Likewise ratchet wheel driven teeth 24A are driven in forward rotation. When piston rods 8A1 and 8A2 are retracted, drive pawl spring 23A is extended by drive pawl 22A when driving teeth 25A ratchet back over ratchet wheel driven teeth 24A to the withdrawn position. These actions affect a hollow drive assembly 26A that rotates relative to housing 2A around a drive axis $B_{1A}$. During operation tool 1A creates and passes a turning force 91A to a threaded fastener (not shown) in one direction 93A and a corresponding reaction force 2A in another direction 94A to a stationary object (not shown) both along a drive axis $B_{1A}$. Tool 1A also includes: a rear swivel assembly 30A.

FIG. 20 also shows an automatic reaction pawl assembly ("ARPA") 200 of the present invention. ARPA 200 includes: a shaft assembly 201; a pawl assembly 202 freely rotatable about shaft assembly 201; and a lever assembly 203 compressionally coupled with pawl assembly 202 about shaft assembly 201. Note that either pawl assembly 202, lever assembly 203 or both pawl assembly 202 and lever assembly 203 may be freely rotatable about the shaft assembly. A lever assembly compression spring assembly 205 overcomes a housing assembly compression spring assembly 210 of pawl assembly 202 which disengages from ratchet 18A. A housing compression spring assembly 210 of pawl assembly 202 is formed between and resistively attached to power tool 1A to restrict rotation of pawl assembly 202 about shaft assembly 201.

ARPA 200 is rotatably attached to an inner side of a lower peripheral wall of driving section 4A of housing 2A by means of housing compression spring assembly 210. Spring assembly 210 is formed between and resistively attached to pawl 207 and tool 1A. It restricts rotation of pawl assembly 202 (and therefore lever assembly 203) about shaft assembly 201. ARPA 200 is held in position against ratchet wheel 18A by rotational spring pressure from spring 110. ARPA 200 is held in position relative to housing 2A by screws 117 (not shown). Generally ARPA 200 engages ratchet teeth 4A and allows ratchet wheel 18A to rotate in a forward direction by spring action, but prevent back rotation when engaged. This keeps ratchet wheel 18A from rotating back with drive pawl 21A.

Often at the end of a piston stroke(s) the fastener reaches full torque and ARPA 200 drops into a ratchet tooth 24A. Stress between pass-through socket 26A or other driver and a reaction mechanism (not shown) causes tool 1A to lock into place due to torsional flex of housing 2A and drive assembly 21A. The operator re-pressurizes tool 1A to relax and remove it from the tightened fastener. With tool 1A in this re-pressurized and flexed condition the reaction force is redistributed from ARPA 200 to drive pawl assembly 21A and housing 2A.

Advantageously, ARPA 200 increases bolting efficiency, torque accuracy and operator safety. Lever compression spring 206 of lever assembly 203 automatically overcomes housing compression spring 213 and disengages pawl assembly 202 from ratchet wheel 18A. Pawl assembly 202 releases without advancing the fastener, touching tool 1A or raising the hydraulic pressure beyond an intended torque value. This allows for hands free operation of one or more tools. During SIMULTORC®, the operator no longer needs to determine which tool is locked on to its fastener.

Figure 21:
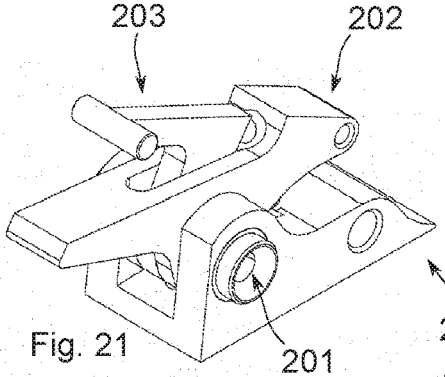
FIG. 21 is a perspective view of the second embodiment of the apparatus.
Figure 22:
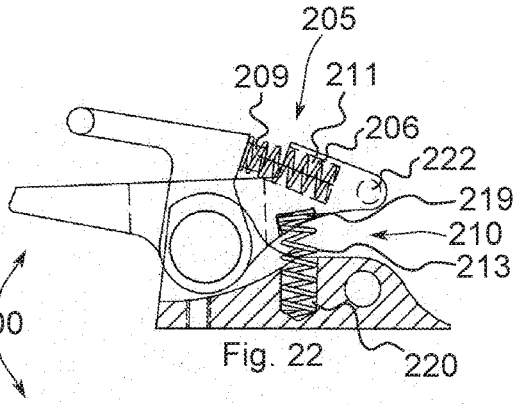
FIG. 22 is a cross-sectional view showing internal parts of the second embodiment of the apparatus.
Figure 23:
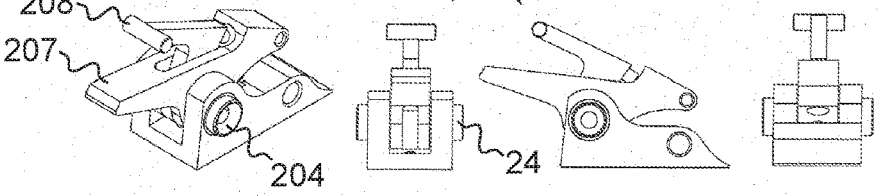
FIG. 23 shows various views of the second embodiment of the apparatus.
Figure 24:
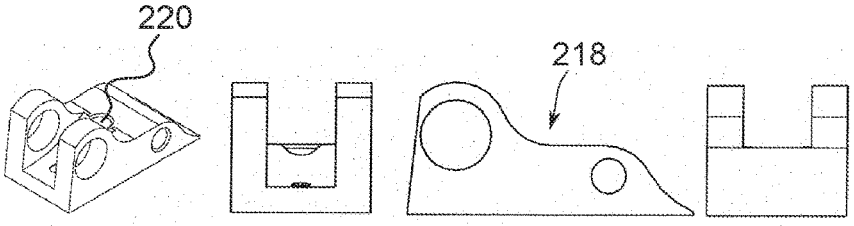
FIG. 24 shows various views of the base of the second embodiment of the apparatus.
Figure 25:
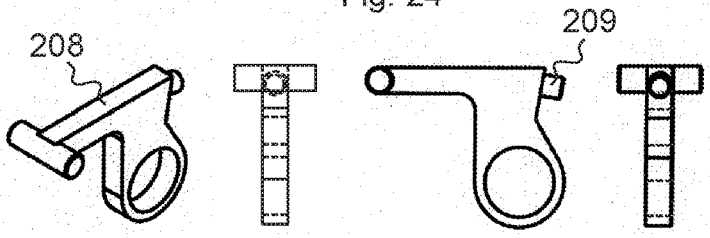
FIG. 25 shows various view of a lever of the second embodiment of the apparatus.
Figure 26:
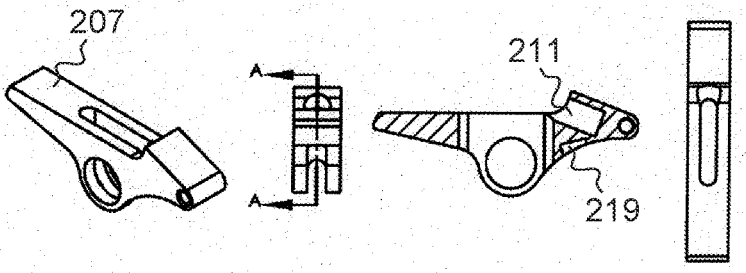
FIG. 26 shows various views of a pawl of the second embodiment of the apparatus.

FIGS. 21-23 show various views of ARPA 200. More specifically, FIG. 21 shows a perspective view of ARPA 200. FIG. 22 shows a cross-sectional view of internal components of ARPA 200. FIG. 23 shows second perspective, front, side and back views of ARPA 200. FIGS. 24-26 show various views of the components of ARPA 200 including optional spacer base assembly 218, lever 208 and pawl 207. More specifically, FIG. 24 shows perspective, front, side and back views of optional spacer base assembly 218. FIG. 25 shows perspective, front, side and back views of lever 208. FIG. 26 shows perspective, back, cross-sectional and top views of pawl 207.

Shaft assembly 201 includes: a shaft 204; a first and a second threaded screw 217 (not shown). Shaft assembly 201 may include an optional spacer base assembly 218 formed between and to support shaft 204 and housing 2A on driving section 4A. Alternatively shaft 204 may attach directly to inner lower sidewalls of housing 2A on driving section 4A. Shaft 204 is shown as a round rod. Shaft 204 includes axial bores at each end to receive threaded portions of screws 217.

Pawl assembly 202 includes: a reaction pawl 207; and a housing compression spring assembly 210 having a housing compression spring 213; a first housing spring depression 219 formed within pawl 207; and a second housing spring depression 220 formed within an optional spacer base assembly 218. Pawl assembly 202 also includes a guide pin assembly 222 which allows for rotatable manipulation of pawl assembly 202 by the operator from outer lower sidewalls of housing 2A on driving section 4A. Note that in absence of spacer base assembly 218, housing compression spring 213 may connect to pawl 207 and tool 1A in a similar manner as housing compression spring 110 of ARPA 100.

Pawl 207 is shown as an irregular shape solid but may be any suitable geometry. An axial round bore at a lower end of pawl 207 receives shaft 204 to rotatably engage pawl assembly 202 to shaft assembly 201. A front end of pawl 207 is tapered to suitably engage ratchet teeth 24A of ratchet wheel 18A. First housing spring depression 21 receives a first end of housing compression spring 210. First housing spring depression 219 has an end point at a bottom surface near a back end of pawl 207. Second housing spring depression 220 receives a second end of housing compression spring 210. Second housing spring depression 220 has an end point at a top surface near the middle of optional spacer base assembly 218. Spring 210 resistively attaches pawl 207 and tool 1A and restricts rotation of pawl 107 relative to tool 1A.

Lever assembly 203 includes: a compression lever 208; and a lever spring assembly 205 having: a lever compression spring 206; a lever spring projection 209 formed on lever 208; and a lever spring depression 211 formed within reaction pawl 107. Compression lever 208 is shown as an irregular shape solid but may be any suitable geometry. An axial round bore at a lower end of compression lever 208 receives shaft 204 to rotatably engage lever assembly 203, pawl assembly 202 and shaft assembly 201. When assembled, a T-shaped projection of lever 108 extends through a hollow slot and beyond a top surface of lever 108. hollow underside portion of torsion lever 108 receives a substantial portion of pawl 107. The front end of pawl 207 extends beyond the T-shaped projection of torsion lever 108. The T-shaped projection of lever 208 is rounded to follow an outer contour 30A and 31A and an inner guide slot 32A and 33A of drive plates 10A and 11A of tool 1A. Lever assembly 103 is compressionally coupled with pawl assembly 102 about shaft assembly 101. Lever spring projection 209 is formed on a back side of the T-shaped projection of lever 208. Lever spring depression 211 is formed within a back end of reaction pawl 107. Movement of the T-shaped projection is rotatably bound within the hollow slot of pawl 107 and compressionally bound by lever compression spring 206.

Similar to FIGS. 14-19, various stages of an industrial bolting operation of tool 1A having ARPA 200 will be discussed, but without corresponding figures. At a beginning of a retract portion of a piston stroke, pistons 7A1 and 7A2 and drive plates 10A and 11A are fully advanced. Drive pawl spring 23A is slightly loaded which provides slight resistive force against drive pawl 21A and drive plates 10A and 11A. Drive pawl 21A is slightly engaged with a first and a second ratchet tooth 24Aa and 24Ab and applies no force to ratchet 24A. Housing compression spring assembly 210 is slightly loaded which provides slight resistive force against pawl assembly 202 and housing 2A. Pawl assembly 202 is disengaged from a fifth ratchet tooth 24Ae and provides no resistive force to prevent ratchet 24A from turning back. Lever spring assembly 205 is minimally loaded as pawl assembly 202 and lever assembly 203 are at the defined rotatably relative neutral position. Lever 208 is at a base contour 30A and 31A of drive plates 10A and 11A.

During the retract portion of the piston stroke, pistons 7A1 and 7A2 and drive plates 10A and 11A are partially retracted. Drive pawl spring 23A is slightly loaded which provides slight resistive force against drive pawl 21A and drive plates 10A and 11A. Drive pawl 21A is minimally engaged with first and second ratchet teeth 24Aa and 24Ab and applies minimal force to push ratchet 24A forward. Housing compression spring assembly 210 is slightly loaded which provides slight resistive force against pawl assembly 202 and housing 2A. Pawl assembly 202 is moderately engaged with fifth ratchet tooth 24Ae and applies sufficient force to prevent ratchet 24A from turning back. Lever spring assembly 205 is moderately loaded as pawl assembly 202 and lever assembly 203 are moderately beyond the defined rotatably relative neutral position. Lever 208 starts to ride up the outer contour 30A and 31A of drive plates 10A and 11A.

At the end of the retract portion and/or the beginning of an advancement portion of the piston stroke, pistons 7A1 and 7A2 and drive plates 10A and 11A are fully retracted (or minimally advanced). Housing compression spring assembly 210 is fully loaded which provides full resistive force against drive pawl 21A and drive plates 10A and 11A and Drive pawl 21A is disengaged from the second and a third ratchet tooth 24Ab and 24Ac and applies no force to push ratchet 24A forward. Drive pawl 21A is moderately engaged with a fourth ratchet tooth 24Ad and applies moderate force to pull ratchet 24A back. Housing compression spring assembly 210 is slightly loaded which provides slight resistive force against pawl assembly 202 and housing 2A. Pawl assembly 202 is fully engaged with fifth ratchet tooth 24Ae and force is applied to prevent ratchet 24A from turning back. Lever spring assembly 205 is fully loaded as pawl assembly 202 and lever assembly 203 are fully beyond the defined rotatably relative neutral position. Lever 208 is at an apex outer contour 30A and 31A and apex guide slot position 32A and 33A of drive plates 10A and 11A.

During the advancement portion of the piston stroke, pistons 7A1 and 7A2 and drive plates 10A and 11A are partially advanced. Drive pawl spring 23A is minimally loaded which provides minimal resistive force against drive pawl 21A and drive plates 10A and 11A. Drive pawl 21A is fully engaged with the second and third ratchet tooth 24Ab and 24Ac and applies full force to push ratchet 24A forward. Housing compression spring assembly 210 is slightly loaded which provides slight resistive force against pawl assembly 202 and housing 2A. Pawl assembly 202 is slightly engaged with yet starts to disengage from fifth ratchet tooth 24Ae. Pawl assembly 202 disengages from fifth ratchet tooth 24Ae to return to relaxed position as ratchet 24A is further advanced. Lever spring assembly 205 is slightly loaded as pawl assembly 202 and lever assembly 203 are slightly beyond the defined rotatably relative neutral position. Lever 208 starts to ride down outer contour 30A and 31A and guide slot 32A and 33A of drive plates 10A and 11A thereby relaxing springs 106 to slightly loaded.

At an end of the advancement portion of the piston stroke, pistons 7A1 and 7A2 and drive plates 10A and 11A are fully advanced. Drive pawl spring 23A is minimally loaded which provides minimal resistive force against drive pawl 21A and drive plates 10A and 11A. Drive pawl 21A is moderately engaged with the second and third ratchet tooth 24Ab and 24Ac and applies moderate hydraulic force to push ratchet 24A forward. Housing compression spring assembly 210 is slightly loaded which provides slight resistive force against pawl assembly 202 and housing 2A. Pawl assembly 202 is disengaged from a sixth ratchet tooth 24Af and applies no force to prevent ratchet 24A from turning back. Lever spring assembly 205 is minimally loaded as pawl assembly 202 and lever assembly 203 are at the defined rotatably relative neutral position. Lever 20S is at the base outer contour 30A and 31A of drive plates 10A and 11A.

In a relaxed setting with ARPA 200 in a disengaged position, pistons 7A and 7B and drive plates 10A and 11A are fully retracted. Drive pawl spring 23A is minimally loaded which provides minimal resistive force against drive pawl 21A and drive plates 10A and 11A. Drive pawl 21A is slightly engaged with ratchet 24A yet applies no force to ratchet 24A. Housing compression spring assembly 210 is fully loaded which provides full resistive force against pawl assembly 202 and housing 2A. Pawl assembly 202 is disengaged from ratchet 24A and applies no force to prevent ratchet 24A from turning back. Lever spring assembly 205 is slightly loaded as pawl assembly 202 and lever assembly 203 are slightly beyond the defined rotatably relative neutral position. ARPA lever 108 is at an apex outer contour 30A and 31A and apex guide slot position 32A and 33A of drive plates 10A and 11A.

Generally this embodiment of the automatic reaction pawl assembly of the present invention prevents back rotation of a ratchet of a pass-through socket drive assembly-type power tool for tightening and/or loosening threaded fasteners. This embodiment of the automatic reaction pawl assembly includes: a shaft assembly; a pawl assembly; and a lever assembly. The lever assembly is compressionally coupled with the pawl assembly about the shaft assembly. Note that either the pawl assembly, the lever assembly or the pawl assembly and the lever assembly are freely rotatable about the shaft assembly. A compression spring of the pawl assembly is formed between and resistively attached to the power tool, wherein the compression spring restricts rotation of the pawl assembly about the shaft assembly. A guide pin assembly of the pawl assembly which allows for rotatable manipulation of the pawl assembly from an outer wall of the power tool. The shaft assembly includes a spacer base assembly such that the pawl assembly and the lever assembly are formed between the spacer base assembly which is formed between and allows assembly of and attachment of the apparatus to the power tool. The spacer base assembly is fixed rotatably relative to the pawl assembly and the lever assembly and attached to the power tool by a threaded screw assembly of the shaft assembly.

Advantageously resistive force against relative rotation of the pawl assembly and the lever assembly allows an operator to pressurize the power tool to a flexed condition to disengage this embodiment of the automatic reaction pawl assembly from the ratchet without advancing the fastener or touching the power tool. Likewise when the power tool is pressurized to a flexed condition and a reaction force load is transferred from this embodiment of the automatic reaction pawl assembly, resistive force against relative rotation of the pawl assembly and the lever assembly disengages the reaction pawl assembly from the ratchet. Further, resistive force against relative rotation of the pawl assembly and the lever assembly increases from a defined neutral position when the lever assembly follows a contour and a guide slot of drive plates of the power tool. The lever assembly compression spring assembly overcomes the pawl assembly compression spring and disengages the pawl assembly from the ratchet when the power tool is pressurized to a flexed condition and a reaction force load is transferred from this embodiment of the automatic reaction pawl assembly.

Note that a slightly modified version of ARPA 100 would be compatible with tool 1A. Note that a slightly modified version of ARPA 200 would be compatible with tool 1. Note that power tools of the present invention for tightening or loosening fasteners: may include either ARPA 100, ARPA 200 or modifications thereof; and may be electrically, hydraulically or pneumatically driven. Note that systems of the present invention for fastening objects include a threaded fastener and such power tools.

Note that methods of the present invention of tightening or loosening threaded fasteners include using either such threaded fasteners; such automatic reaction pawl assemblies or modifications thereof; such power tools; such systems; or any combination thereof. One such method includes: providing such an object to be tightened; providing such a threaded fastener to the object to be tightened; providing such a power tool having such an automatic reaction pawl assembly; and tightening the threaded fastener. One such method includes: providing such an object to be loosened; identifying such a threaded fastener to loosen the object to be loosened; providing such a power tool having such an automatic reaction pawl assembly; and loosening the identified threaded fastener.

It will be understood that each of the elements described above, or two or more together, may also find a useful application in other types of constructions differing from the types described above. The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

While the invention has been illustrated and described as embodied in a fluid operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

When used in this specification and claims, the terms "comprising", "including", "having" and variations thereof mean that the specified features, steps or integers are included. The terms are not to be interpreted to exclude the presence of other features, steps or components.

What is claimed is:

1. An apparatus to prevent back rotation of a ratchet of a power tool for tightening and/or loosening threaded fasteners including:

a shaft assembly;

a pawl assembly fixed rotatably relative to the shaft assembly, the pawl assembly having a compression spring formed between and resistively attached to the power tool, wherein the compression spring restricts rotation of the pawl assembly and the shaft assembly relative to a lever assembly; and the lever assembly torsionally coupled with the pawl assembly about the shaft assembly.

2. An apparatus according to claim 1 including:

wherein the lever assembly is compressionally coupled with the pawl assembly about the shaft assembly; and wherein the pawl assembly and the lever assembly are freely rotatable about the shaft assembly.

3. An apparatus according to claim 1 wherein the power tool for tightening or loosening fasteners includes a square drive assembly.

4. An apparatus according to claim 1 including a torsion spring assembly of the lever assembly formed between and resistively rotatably coupled to the shaft assembly and a first and a second bushing of the lever assembly.

5. An apparatus according to claim 4 wherein the bushings are fixed rotatably relative to the shaft assembly and formed between the torsion spring assembly and a threaded screw assembly of the shaft assembly.

6. An apparatus according to claim 5 wherein the screw assembly is formed at axial ends of the shaft assembly and allows assembly of and attachment of the apparatus to the power tool.

7. An apparatus to prevent back rotation of a ratchet of a power tool for tightening and/or loosening threaded fasteners including:

a shaft assembly;

a pawl assembly;

a lever assembly compressionally coupled with the pawl assembly about the shaft assembly; and wherein the pawl assembly and the lever assembly are rotatable about the shaft assembly.

8. An apparatus according to claim 7 wherein the power tool for tightening or loosening fasteners includes a pass-through socket drive assembly.

9. An apparatus according to claim 7 including a compression spring of the lever assembly formed between and resistively rotatably coupled relative to the pawl assembly.

10. An apparatus according to claim 9 including a guide pin assembly of the pawl assembly which allows for rotatable manipulation of the pawl assembly from an outer wall of the power tool.

11. An apparatus according to claim 9 including a spacer base assembly of the shaft assembly, wherein the pawl assembly and the lever assembly are formed between the spacer base assembly which is formed between and allows assembly of and attachment of the apparatus to the power tool.

12. An apparatus according to claim 7 including a compression spring of the pawl assembly formed between and resistively attached to the power tool, wherein the compression spring restricts rotation of the pawl assembly about the shaft assembly.

13. An apparatus according to claim 7 wherein when the power tool is pressurized to a flexed condition and a reaction force load is transferred from the apparatus, a compression spring assembly of the lever assembly overcomes a compression spring of the pawl assembly and disengages the pawl assembly from the ratchet.

14. An apparatus according to claim 1 or 7 wherein resistive force against relative rotation of the pawl assembly and the lever assembly allows an operator to pressurize the power tool to a flexed condition to disengage the pawl assembly from the ratchet without advancing the fastener or touching the power tool.

15. An apparatus according to claim 1 or 7 wherein when the power tool is pressurized to a flexed condition and a reaction force load is transferred from the apparatus, resistive force against relative rotation of the pawl assembly and the lever assembly disengages the pawl assembly from the ratchet.

16. An apparatus according to claim 1 or 7 wherein resistive force against relative rotation of the pawl assembly and the lever assembly increases from a defined neutral position when the lever assembly follows either a contour, a guide slot or a contour and a guide slot of drive plates of the power tool.

17. An apparatus according to claim 1 or 7 wherein torsional flex in the power tool allows an operator to pressurize the power tool to disengage the pawl assembly from the ratchet without advancing the fastener or touching the power tool.

18. An apparatus according to claim 1 wherein when the power tool is pressurized to a flexed condition and a reaction force load is transferred from the apparatus, a torsion spring assembly overcomes the compression spring and disengages the pawl assembly from the ratchet.

19. An apparatus according to claim 1 or 7 wherein the power tool is either electrically, hydraulically or pneumatically driven.

20. A power tool for tightening or loosening fasteners including an apparatus of claim 1 or 7.

21. A system for fastening objects including:

a threaded fastener; and a power tool for tightening or loosening fasteners including an apparatus of claim 1 or 7.

* * * * *